US008152239B2

(12) United States Patent
Opsvik

(10) Patent No.: US 8,152,239 B2
(45) Date of Patent: Apr. 10, 2012

(54) SAFETY BOW FOR A CHILDREN'S CHAIR

(75) Inventor: Peter Opsvik, Oslo (NO)

(73) Assignee: Peter Opsvik AS (NO)

( * ) Notice: Subject to any disclaimer, the term of this patent is extended or adjusted under 35 U.S.C. 154(b) by 0 days.

(21) Appl. No.: 12/280,549

(22) PCT Filed: Feb. 23, 2007

(86) PCT No.: PCT/NO2007/000072

§ 371 (c)(1),
(2), (4) Date: Oct. 1, 2008

(87) PCT Pub. No.: WO2007/097638

PCT Pub. Date: Aug. 30, 2007

(65) Prior Publication Data

US 2009/0134689 A1 May 28, 2009

(30) Foreign Application Priority Data

Feb. 24, 2006 (NO) ..... 20060919

(51) Int. Cl.
*A47D 1/10* (2006.01)

(52) U.S. Cl. ..... 297/256.15; 297/148; 297/149

(58) Field of Classification Search ..... 297/148, 297/149, 153, 174 R, 174 CS, 256.15
See application file for complete search history.

(56) References Cited

U.S. PATENT DOCUMENTS

| | | | | |
|---|---|---|---|---|
| 1,178,894 | A * | 4/1916 | Wilcox | 297/153 |
| 3,335,434 | A * | 8/1967 | Gamon | 297/153 |
| 4,650,246 | A * | 3/1987 | Henriksson | 297/256.15 |
| 5,317,765 | A * | 6/1994 | Knoedler et al. | 4/572.1 |
| 5,334,099 | A | 8/1994 | Marra et al. | |
| 5,438,043 | A * | 8/1995 | Ljungqvist | 514/23 |
| 5,687,433 | A * | 11/1997 | Garner et al. | 4/572.1 |
| 5,730,493 | A * | 3/1998 | Fornasari et al. | 297/238 |
| 5,810,432 | A * | 9/1998 | Haut et al. | 297/153 |
| 5,927,805 | A | 7/1999 | Hilger et al. | |
| 6,024,412 | A * | 2/2000 | Kain et al. | 297/467 |
| 6,416,132 | B1 * | 7/2002 | Norton et al. | 297/467 |
| 6,626,487 | B1 * | 9/2003 | Buitendach | 297/153 |

FOREIGN PATENT DOCUMENTS

| | | | |
|---|---|---|---|
| DE | 4329692 | A1 | 10/1994 |
| DE | 10202735 | A1 | 8/2003 |
| DE | 10229436 | A1 | 1/2004 |
| EP | 0182761 | B1 | 4/1988 |
| EP | 1388311 | A1 | 11/2004 |
| FR | 2856564 | A1 | 6/2003 |
| WO | 95/30360 | A1 | 11/1995 |

* cited by examiner

*Primary Examiner* — Sarah B Mcpartlin

(74) *Attorney, Agent, or Firm* — Kolisch Hartwell, P.C.

(57) ABSTRACT

The present invention concerns a safety bow (40) for use in children's chair (1) comprising a seat plate (2), a backrest (3, 4) and possibly two side pieces (5), wherein the backrest or side pieces have at least one opening each, the safety bow being a three armed constructional part in one piece comprising: two first ends (43) with first and second connecting members (44) for hooking into the opening(s) in the backrest (3, 4) or the side pieces (5); and a third end comprising a third connecting member (46) for detachable fixing to the seat plate (2). The invention also concerns the use of the safety bow in a children's chair.

22 Claims, 4 Drawing Sheets

SAFETY BOW FOR A CHILDREN'S CHAIR

The present invention concerns a safety bow for a children's chair, such as a chair for wherein the seat plate has a vertical hole in front, possibly with the potential of vertical and horizontal adjustment of the seat plate. Further, the invention concerns the use of a safety bow in a children's chair.

BACKGROUND OF THE INVENTION

It is well known that children, that is children such as in the age from when they may sit by themselves (about 6-7 month) until they master sitting safely in a children's chair without falling out (about 2 years), need safety equipment hindering them from falling out of a children's chair.

Blockings are often used, such as bows or crossbars, possibly combined with a vertical strap or bar in children's chairs for this objective. Possibly, the entire seat of the chair may be shape moulded as a seat with integrated cross bow and crotch bar. The disadvantage with shape moulded chairs is that the seat may not be adjusted in relation to the size and age of the child. Often, such physical blocks in the seat are combined with a harness in order to secure the child from climbing out of the chair. However, a physical block may be used alone when the child is so small that it is unable to climb out, or to provide extra physical support that a harness may not provide alone.

From SE 451 530 a safety bow is known for a children's seat to be mounted onto a conventional chair by straps. The safety bow has two horizontal ends for connecting onto corresponding horizontal top surfaces on side pieces or the seat. The side pieces are hollow with holes in the top surface for entering screws from the underside and into receiving holes on the underside of the bows ends. The bow also comprises a centre piece with a peg in the bottom end for fitting into a hole in the children's seat.

Further, from EP 1 388 811 a limiting ring is known for a children's seat to be mounted onto a conventional chair. The limiting ring has two horizontal ends, for being associated with the back of the seat, and a separate supporting centre rod, with a lower threaded end for screwing into a threaded hole in the children' seat and a top end to be attached to the limiting ring by a cap.

In later years, a development has evolved in the direction of more countries and regions having their own safety measures for equipment to be used by children, such as in children's chairs. This must be taken into account in the development of new children's chairs, but it may be difficult to adapt chairs which have been produced in a long period before such safety provisions were put into force. It is especially difficult to perform such adoptions on chairs that have already been sold for many years, without making physical interventions in the chairs. There are thousands of chairs around in homes.

This is for example the case with the Tripp Trapp® children's chair which was developed as early as in 1972 and patented in 1976 and which still is a very popular children's chair in many countries.

The chair is designed to be adjusted in coherence with the body size of the child and therefore has a seat plate and a foot plate which may be moved to different height positions in that they glide in tracks in the side pieces and are locked by tightening the distance between the side pieces. The sitting plate may further be adjusted in the depth position in that a plate is pushed in relation to the seat back, and thereby providing the child using the chair a correct seat length under the thighs.

It has proven difficult to adapt existing seats to new effective demands, especially in order to keep the above mentioned original functions of the chair. In order to achieve this, the attachment of a safety bow for example should be able to follow the height and depth position of the seat.

In addition to fastening a safety bow to such chairs, it may also be mentioned that it could be desirable to mount a children's harness which may be used simultaneously with the safety bow.

It is a further objective to provide a fastening means for such additional equipment as mentioned above so that the owners of older chairs also may upgrade their chairs. It is also an objective to avoid physical interventions, such as making holes in any of the parts or inserting screws that leave spoiling marks in the chair which will be visible when there no longer is any use for the children's harness or the safety bow. Such interventions may further result in the risk of the user making adaptations on the wrong manner, so that the safety is not kept intact. It is therefore an objective with the invention to make the fastening of the additional equipment as intuitive and simple as possible, upholding safety at the same time, preferably without the use of tools.

A safety bow should further be simple in design and reasonable to produce, taken into account that the safety bow is only used for a limited period of time, compared to the life of the chair.

DESCRIPTION OF THE INVENTION

In order to attain these objectives the applicant has developed a safety bow which solves the problems mentioned above.

The present invention therefore concerns a safety bow for use in a children's chair with a seat plate, a backrest and possibly side pieces wherein the backrest or the side pieces have at least one opening each, preferably an horizontal opening, and wherein the safety bow is characterized according to claim 1.

The invention will in the following be described in greater detail by the help of embodiments and the attached drawings, none of which are meant to limit the scope of the invention which is only defined by the appended claims.

SHORT DESCRIPTION OF THE DRAWINGS

DETAILED DESCRIPTION

Figure 1:
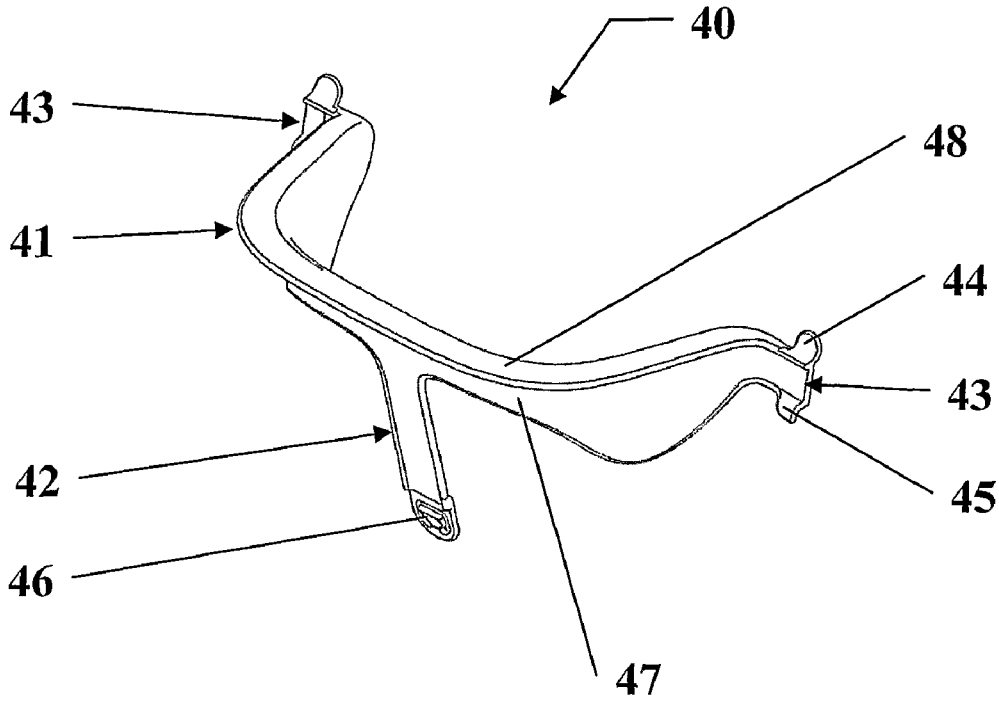
FIG. 1 show a perspective view of the safety bow according to the present invention.

As may be seen from FIG. 1, the safety bow 40 is a three armed bow in one piece, comprising an arced crosspiece 41, and a vertical crotch piece 42.

The arched cross piece 41 has two ends 43 with first and second fixing means 44 for the fastening to a back of a chair or the side pieces in a chair. Similarly, the end of the crotch piece 42 has a third fixing means 46, in this embodiment a snap organ, for fixing to a seat plate of a bracket.

Figure 2:
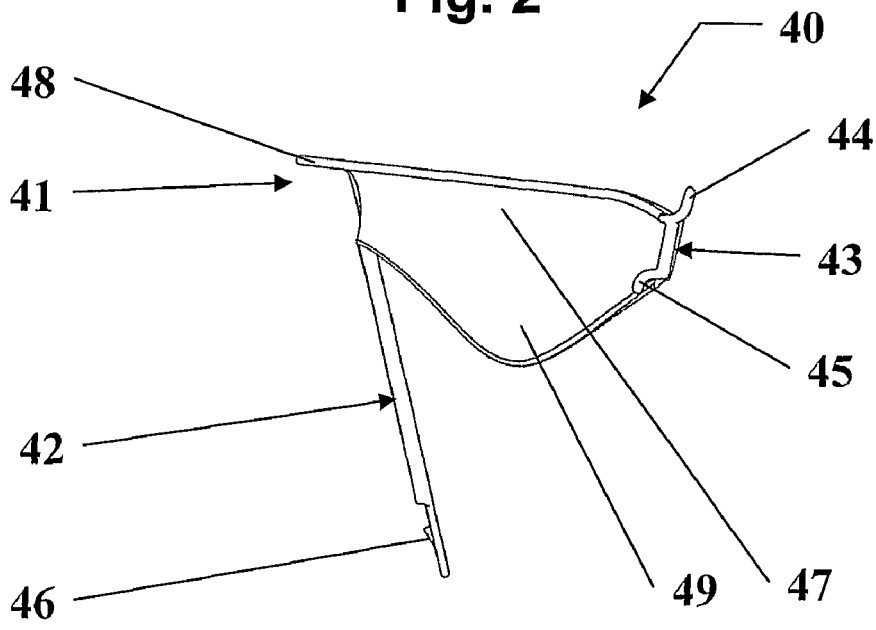
FIG. 2 show a side view of the safety bow in FIG. 1.

As may be seen from FIG. 2, the crosspiece 41 comprises a vertical wrap around band 47 in this embodiment with an upper overhanging flange 48 making up an essentially horizontal surface. The transition between the band 47 and the flange 48 is curved due to comfort consideration for the child and provides a good support for the child's underarms. The construction also provides the crosspiece with added rigidity and strength, as well as torsion stability.

Figure 3:
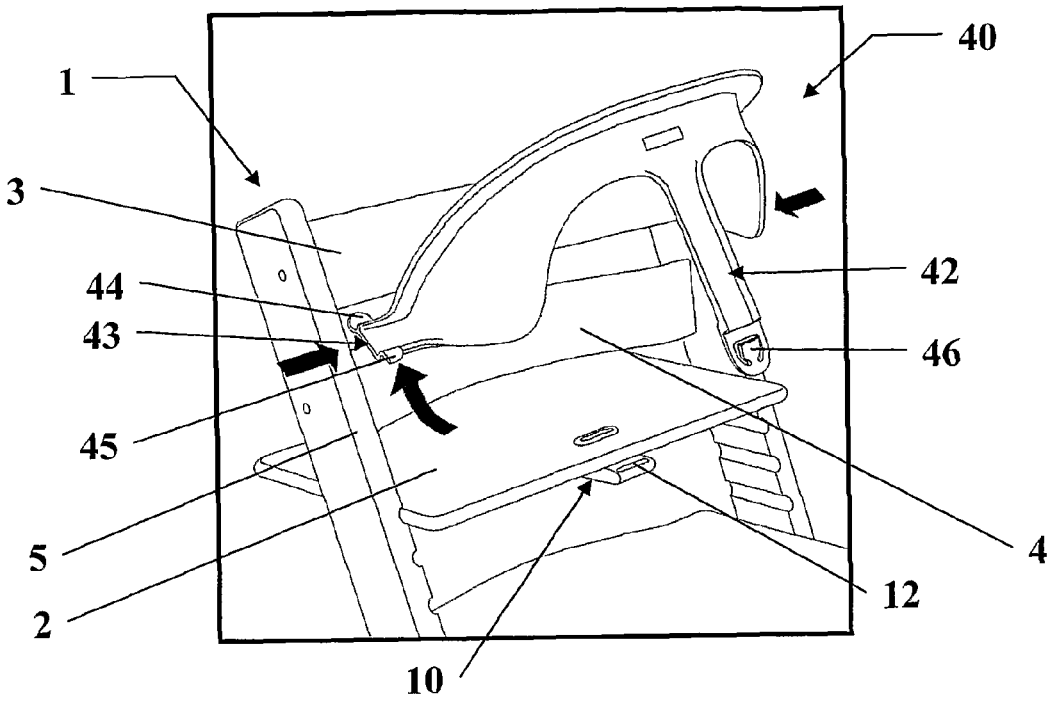
FIG. 3 shows an installation drawing of the safety bow during fastening to a children's chair.

On account of safety regulations in some countries it may also be of interest that the band 47 in the crosspiece has a varying width so that it may be deeper in some places where it is desirable to limit the mobility of the child or to reduce the size or shape of the opening defined by the seat plate 2 and the bow 40, as shown in FIG. 3. In this embodiment the band 47 as an increased downward directed width in the side portions with flaps 49 on each side in the area between the ends 43 and the crotch strap 42.

Figure 4:
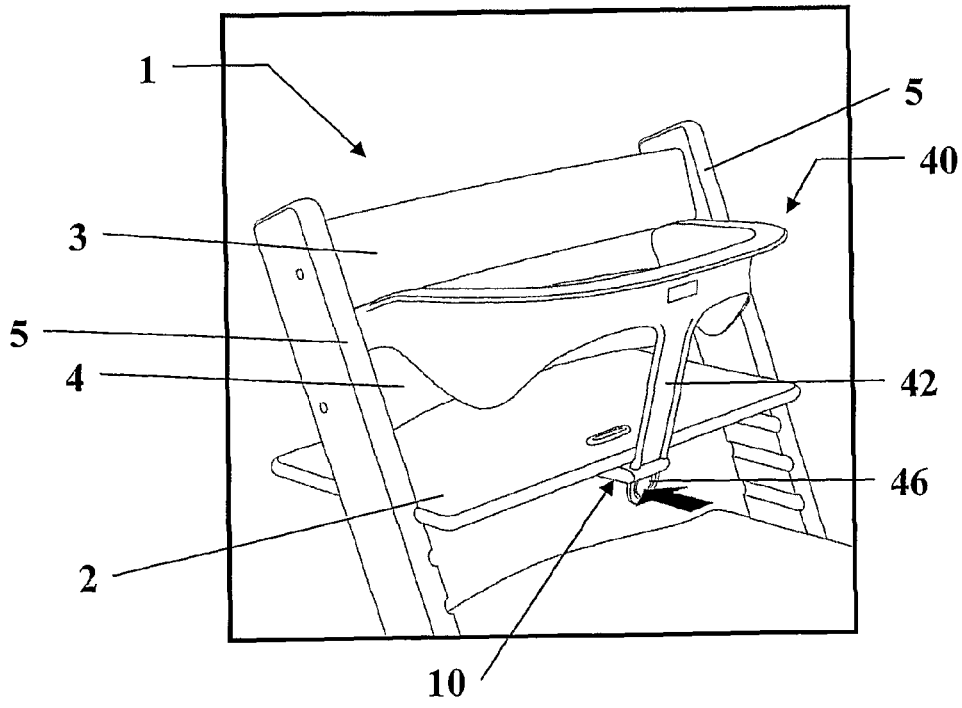
FIG. 4 shows the safety bow in FIG. 3 installed in a children's chair.

In FIG. 3 it is further shown how the safety bow is mounted in a children's chair. As may be seen from FIG. 2, the connecting members comprise upward pointing shoes 44 bent backwards in relation to the cut off of the ends 43, and in FIG. 3 it is shown how these shoes 44 are hooked in between the upper crosspiece 3 and the lower crosspiece 4 of the backrest in the chair 1. The bow 40 is then rotated down in front so that the shoes 44 are pressed forward in the top edge until the connecting member 46 in the end of the crotch piece 42 may be connected to a corresponding connecting member in the seat plate 2. In this embodiment, the connecting member in the seat plate 2 is an edge groove 12 in a fixing bracket 10, fixed to the seat plate 2 as shown in FIGS. 3 and 4. The crotch piece 42 being somewhat flexible allows for a depth adjustment of the seat plate according to the size of the child. Depending on the rigidity of the arched cross piece 41, and/or the arrangement of the first and second fixing means 44, the safety bow may also be adapted to a different height positions, such as 2-3 positions, of the seat plate by being tilted upward or downward.

As the crotch piece 42 must absorb the loads exercised on the crossbow 41, it may be preferable that the safety bow 40 further comprises fitting surfaces against the children's chair 1 absorbing such loads. Dependent on the quality and flexibility of the safety bow 40, it may for example be preferable that the ends 43 of the cross piece 41 further comprise stopping members 45 in the form of downward directed stopping shoes bent forward in relation to the ends 43 as shown in FIG. 2. The stopping members 45 will thereby be pressed backward in the top edge on the upper front edge of the bottom crosspiece 4 of the backrest of the chair 1, as shown in FIG. 3. In this manner the safety bow 40 is strained completely firm when locked in seat 2 and is in addition hindered in horizontal backward directed movement at the same time as slack between the chair and safety bow is avoided. Simultaneously, a part of the load on the safety bow is absorbed.

In both the preceding and next embodiment the chair 1 has a backrest, consisting of two horizontal parallel crosspieces 3 and 4 forming a passing opening with a defined height. However, the opening may just as well consist of two separate openings in the backrest or in the side pieces of the chair, such as for example two parallel grooves with a defined height and possibly a defined width. The openings neither need be passing, but may be recesses with for example an edge or a track making locking possible by the hooking of connecting members 44 as shown. The ends 43 of the safety bow may possibly by themselves abut the back of the chair or the side pieces in order to lock the safety bow and hinder backward movement.

Figure 5:
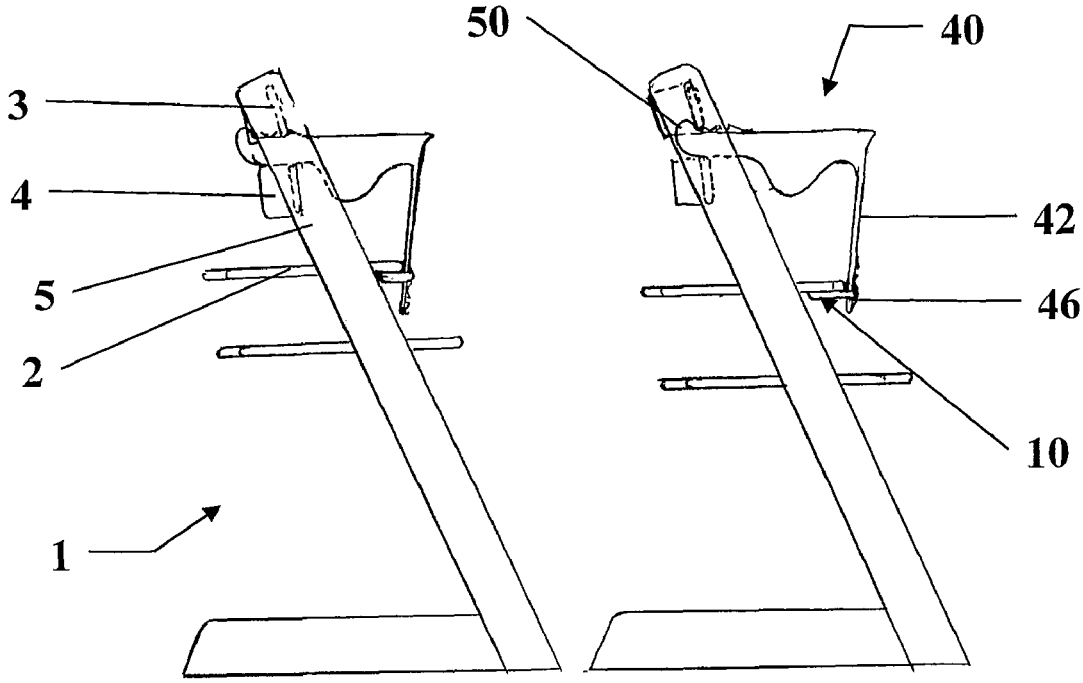
FIG. 5 shows a side view of a second safety bow according to the invention installed in two different horizontal and vertical positions in a children's chair.

In FIG. 5 an alternative embodiment of the present invention is shown wherein the ends 43 of the crosspiece 41 comprise another form of connecting members 50 towards the opening(s) between the crosspieces 3 and 4 of the chair 1. In this embodiment the connecting members 50 comprise protruding extensions of the ends 43 (from the earlier figures) in the backward direction which may pass through opening(s) in the backrest 3, 4. The end of the connecting member 50 is completed with an important upward directed raised part so that the safety bow must be hooked into the opening(s) as described earlier. However, the connecting members 50 are dimensioned with more material in order to absorb higher loads than the organs 44. Thereby, there is no need for further stopping organs 45 in the front of the ends 43.

Figure 7:
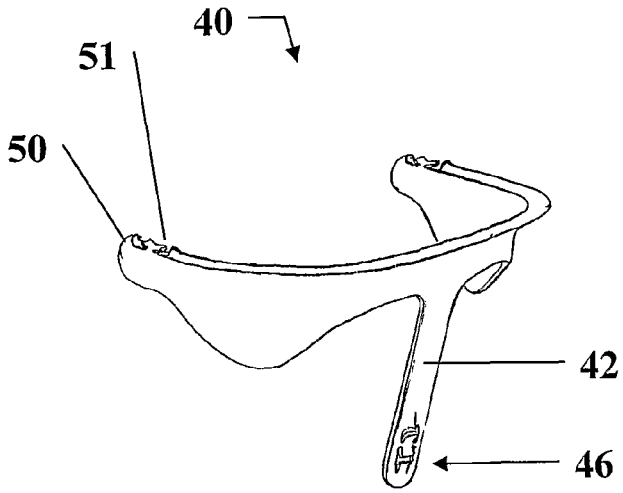
FIG. 7 shows a perspective view of the safety bow in FIG. 6.
Figure 8:
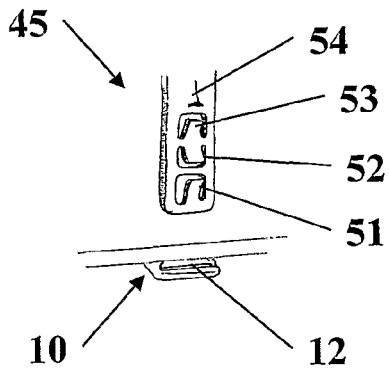
FIG. 8 shows a detail of the safety bow in FIG. 6.

In addition to the raised part 51 the connecting member 50 may also further comprise an additional cross track 52 in the upper edge, as better shown in FIG. 7, and which allows hooking the crosspiece in one additional horizontal depth position closer to the backrest as shown in FIG. 5. Such a position would be of interest for the smallest children using the chair. In connection with increasing the horizontal opening limited by the arched crosspiece 41 of the safety bow and the backrest, it will of interest to lower the seat plate 2 as the child grows by changing from the cross track 52 to the raised part 51. In order to use the relative rigid bow 40 at alternate height positions of the seat plate 2, the connecting member 46 comprises several locking positions. The connecting member 46 comprises several snap locks after one another as shown in detail in FIG. 8.

As shown in FIG. 7, the end of the crotch strap 42 comprises a lower upward directed snap flap 51 such as in the precedent embodiment, but another downward directed snap flap 52 is positioned over this snap flap to hinder the crotch strap 42 in moving down ward by it self, instead of a stopping edge as shown in the FIGS. 1-4. By release of the second snap flap 52, the crotch strap 42 may however be moved further down into the groove 12 and a third upward directed snap flap 53 will lock the crotch strap in a deeper position in the groove 12 and thereby be hindered in moving further down by the help of a fourth snap flap 54.

The crotch strap 42 may further have an additional numbers of snap flaps in order to increase the possibility for adjustment, but the number is limited somewhat to avoid that the length piece protruding out under the seat plate when the safety bow is used in the inner position is in the way.

Figure 6:
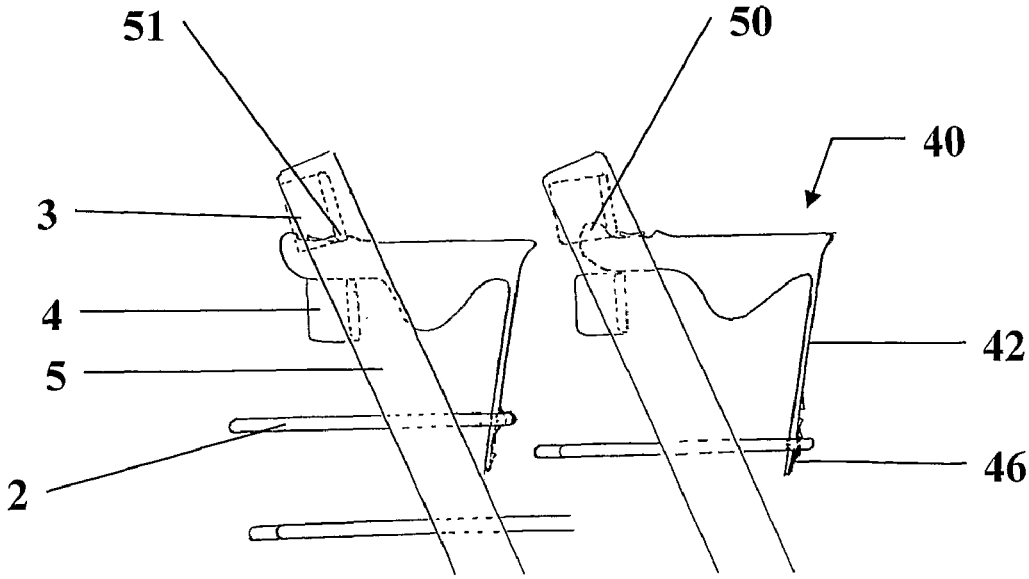
FIG. 6 shows an alternative installation of the safety bow in FIG. 6.

In FIG. 6 an alternative mounting in a children's chair is shown wherein the safety bow 40 is used with direct fixing of the crotch strap 42 by the connecting member 46 in a groove in the seat plate 2 itself. In the original Tripp Trapp® chair there is for example such a groove for fixing of another type of crotch strap. The seat plate 2 may be displaced in the horizontal direction in order to adapt the depth to both the safety bow and the child. In general the fixing of the crotch strap 42 via a bracket 10, as shown in FIG. 5, will provide more space for movement of the child's legs as the crotch strap is fixed on the outside of the seat plate, while the crotch strap is fastened on the outside of the seat plate, while the space in the embodiment according to FIG. 6 is somewhat more limited.

The safety bow may be produced in any suitable material, such as metal, wood, plastic or another synthetic material or a composite material. Preferably the safety bow is made of a semi-rigid material which is unsupported, but has sufficient flexibility for adjustment of the seat depth, preferably made in plastic.

The advantage with the safety bow according to the invention is thus that it may be used on an existing chair, such as Tripp Trapp® chair or other chairs, without making physical changes on any of the parts of the chair, or demand the use of fastening means, such as screws. The safety bow is simply hooked in the back edge only by the help of the existing components and in the front edge by either the existing groove or a bracket on the seat plate. The safety bow may follow the adjustments of the chair both vertically and horizontally to a certain extent, such as by height adjustment and/or depth adjustment of the seat plate, without hindering any of the functions of the chair. The safety bow may easily be removed after use or be moved to another corresponding chair when it is no longer needed. The possibilities for adjustments which the safety bow includes cover the areas of adjustments of the seat plate which are of interest for use for babies and small children.

Another advantage with the safety bow according to the invention is that all necessary fastening members for fixing in a children's chair may be integrated in the safety bow, as shown in FIG. 6, without the need for extra loose parts or the use of tools.

The invention claimed is:

1. A safety bow for use in a child's chair, the child's chair comprising a substantially horizontal seat plate having a hole, a backrest, and optionally one or more side pieces, wherein at least one of the backrest or side pieces have at least one opening, each opening at a defined height; the safety bow comprising a three-armed constructional part in one piece, each arm having an arm end, wherein the first and second arm ends include first and second connecting members and the third arm end includes a third connecting member for detachable fixing to the substantially horizontal seat plate;

the safety bow includes an arched crosspiece that extends in an arch from the first arm end and connecting member to the second arm end and connecting member;

the connecting members include hooked shoes adapted for hooking into the opening(s) in the backrest or the side pieces; and the first and second arm ends include stopping members to hinder backward movement of the ends through the opening(s) in the backrest or the side pieces.

2. The safety bow according to claim 1, wherein the third connecting member is adapted for detachable fastening to the hole, or detachable fastening via a bracket to the hole in the seat plate.

3. The safety bow according to claim 2, wherein the third connecting member is adapted for detachable fastening to the hole, or detachable fastening via a bracket to the hole in the seat plate by snapping.

4. The safety bow according to claim 1, wherein the first and second arm ends include multiple connecting members, or the third connecting member is configured to be detachably fastened to the seat plate at multiple positions, or both;

such that the safety bow is adjustable in at least one of depth and height with respect to the chair's backrest and the chair's one or two side pieces, and/or can adapt to a depth and/or height-adjustable seat plate.

5. The safety bow according to claim 1, wherein said first and second connecting members are adapted to hook into an opening in the backrest defined by an upper crosspiece and lower crosspiece that are arranged in parallel.

6. The safety bow according to claim 1, wherein the arched crosspiece includes a mainly vertical wraparound band having a substantially horizontal upper overhanging flange, and two side portions.

7. The safety bow according to claim 6, wherein the side portions are disposed between the first arm end and the crotch piece and between the second arm end and the crotch piece, and the vertical wraparound band of the crosspiece further includes downward extensions in the side portions so as to limit the opening between the safety bow and the seat plate.

8. The safety bow according to claim 1, wherein the first and second connecting members include upward directed hooked shoes.

9. The safety bow according to claim 1, wherein the safety bow is depth-adjustable in relation to the backrest.

10. The safety bow according to claim 9, wherein each of the first two ends of the first and second arm further comprise at least one hooking groove for depth adjustment of the safety bow through the opening(s) in the backrest or side pieces.

11. The safety bow according to claim 1, wherein the first and second stopping members include downwardly directed stopping shoes.

12. The safety bow according to claim 1, wherein the third connecting member is in the form of an upwardly directed snap flap.

13. The safety bow according to claim 12, where the upwardly directed snap flap includes an overlying stop surface.

14. A children's chair comprising a safety bow according to claim 1.

15. The children's chair according to claim 14, wherein the children's chair has a seat plate and a foot plate which may each be moved to different height and depth positions by being moved in and out of tracks in side pieces of the chair.

16. The children's chair according to claim 14, further comprising a children's harness.

17. The safety bow according to claim 1, wherein the child's chair comprises one or more side pieces, and when the first and second connecting members are detachably fastened to the side pieces of the chair and the third connecting member is detachably fixed to the seat plate of the chair, the arched crosspiece is arched in a horizontal plane.

18. A safety bow for use in a child's chair, the child's chair comprising a seat plate having a hole, a backrest, and optionally one or more side pieces, wherein at least one of the backrest or side pieces have at least one opening, each opening at a defined height; the safety bow comprising a three-armed constructional part in one piece, each arm having an arm end, wherein the first and second arm ends include first and second connecting members and the third arm end includes a third connecting member for detachable fixing to the seat plate;

the safety bow includes an arched crosspiece that extends in an arch from the first arm end and connecting member to the second arm end and connecting member;

the connecting members include hooked shoes adapted for hooking into the opening(s) in the backrest or the side pieces; and the first and second arm ends include stopping members to hinder backward movement of the ends through the opening(s) in the backrest or the side pieces;

wherein the third arm is a substantially vertical crotch piece.

19. A safety bow for use in a child's chair, the child's chair comprising a seat plate having a hole, a backrest, and optionally one or more side pieces, wherein at least one of the backrest or side pieces have at least one opening, each opening at a defined height; the safety bow comprising a three-armed constructional part in one piece, each arm having an arm end, wherein the first and second arm ends include first and second connecting members and a third arm end includes a third connecting member for detachable fixing to the seat plate;

the safety bow includes an arched crosspiece that extends in an arch from the first arm end and connecting member to the second arm end and connecting member;

the connecting members include hooked shoes adapted for hooking into the opening(s) in the backrest or the side pieces; and the first and second arm ends include stopping members to hinder backward movement of the ends through the opening(s) in the backrest or the side pieces;

wherein the third arm is a substantially vertical crotch piece that is height adjustable.

20. The safety bow according to claim 19, wherein the crotch piece includes at least one additional downwardly directed snap flap.

21. The safety bow according to claim 20, wherein the crotch piece further includes one or more additional upwardly directed snap flaps.

22. The safety bow according to claim 20, wherein the crotch piece includes a stopping surface.

* * * * *